US005316355A

United States Patent [19]

Hartwell et al.

[11] Patent Number: 5,316,355

[45] Date of Patent: May 31, 1994

[54] INTEGRAL DOOR KNOB ASSEMBLY WITH SPRING RETURN

[75] Inventors: Rae Hartwell, Surrey; Ian Garben, Burnaby, both of Canada

[73] Assignee: Masco Corporation of Indiana, Taylor, Mich.

[21] Appl. No.: 61,219

[22] Filed: May 13, 1993

[51] Int. Cl.[5] ..... E05B 1/00

[52] U.S. Cl. ..... 292/347; 292/DIG. 38; 292/356; 292/357

[58] Field of Search ..... 292/347, 356, 357, DIG. 38, 292/336.3, 169 R

[56] References Cited

U.S. PATENT DOCUMENTS

| | | | |
|---|---|---|---|
| 2,698,763 | 1/1955 | Young | 292/347 |
| 3,096,115 | 7/1963 | Patriguin et al. | 292/347 |
| 3,179,459 | 4/1965 | Lint | 292/347 X |
| 3,604,741 | 9/1971 | Steere, Jr. | 292/347 |
| 4,000,539 | 1/1977 | Neya | 292/347 X |
| 5,067,758 | 11/1991 | Fann et al. | 292/347 |
| 5,149,155 | 9/1992 | Caeti et al. | 292/357 X |
| 5,190,327 | 3/1993 | Lin | 292/357 X |

*Primary Examiner*—Richard E. Moore

*Attorney, Agent, or Firm*—Leon E. Redman; Malcolm L. Sutherland

[57] ABSTRACT

An integral door knob assembly for mounting on a face of a door has a spring return so that the door knob rotates to one position when released. A shank formed integral with or attached to the door knob is formed of plastic material eliminating the requirement of a separate plastic bushing in the rose member, and has flexible fingers to provide a snap lock between a spring assembly member and the end of the shank to hold the knob assembly to the rose member. The spring assembly member is also formed of plastic material and has sufficient flexibility to allow a torsion spring to be inserted and removed.

11 Claims, 2 Drawing Sheets

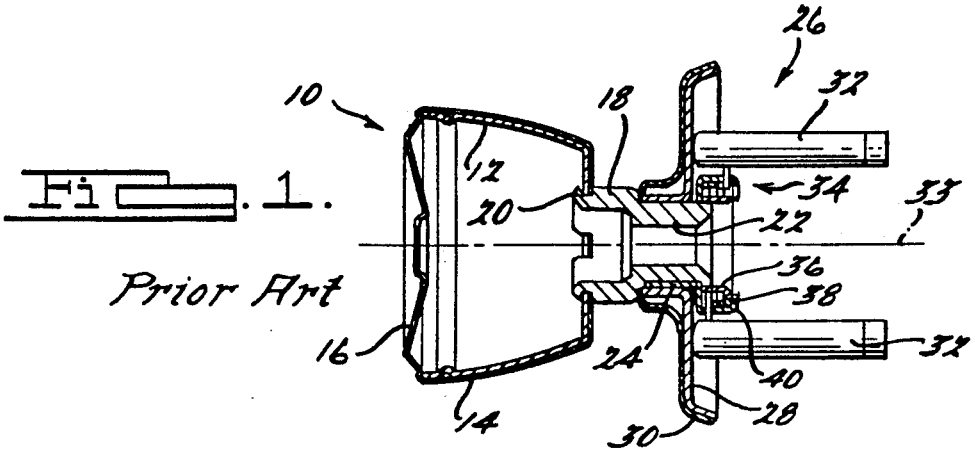
Fig. 1.
Prior Art
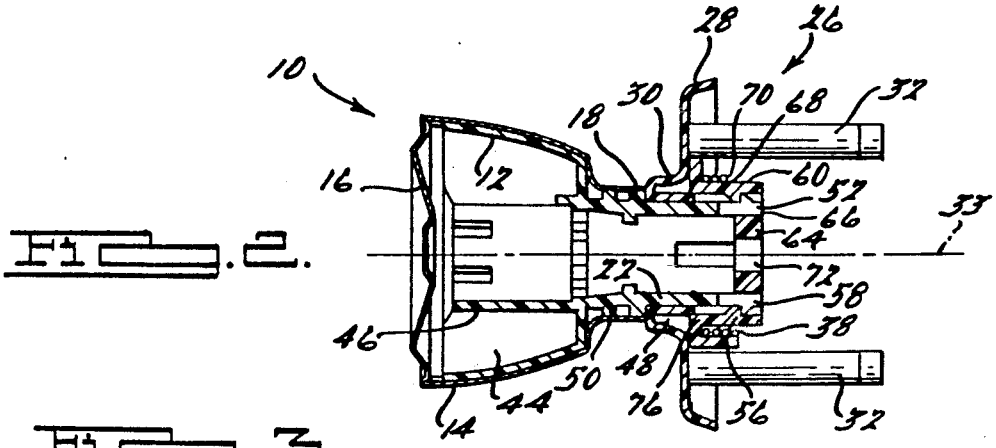
Fig. 2.
Fig. 3.
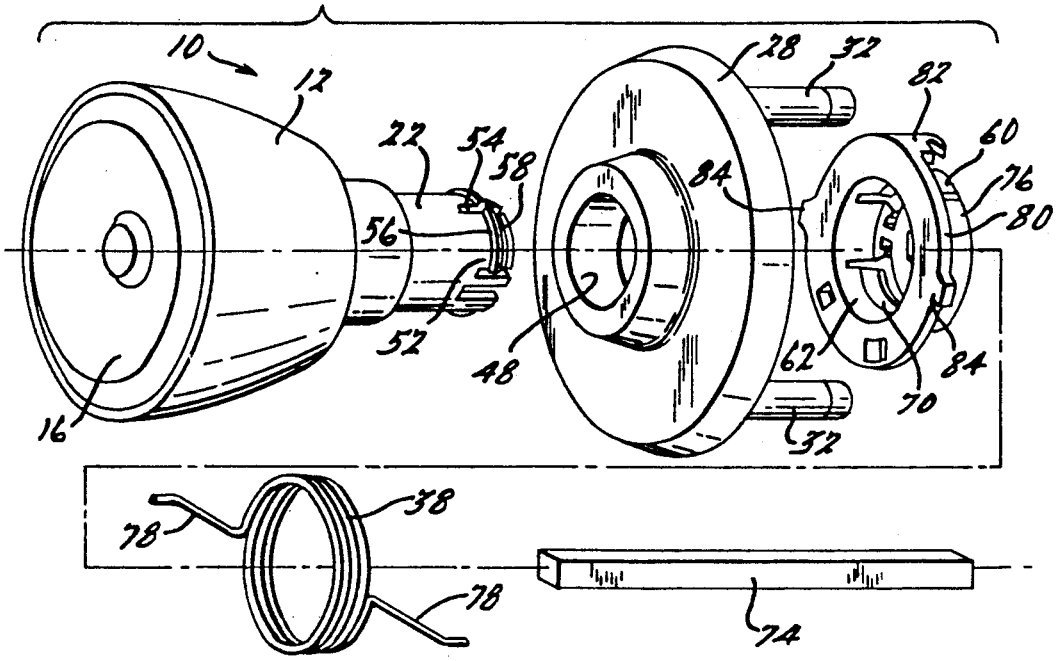

Fig. 7.
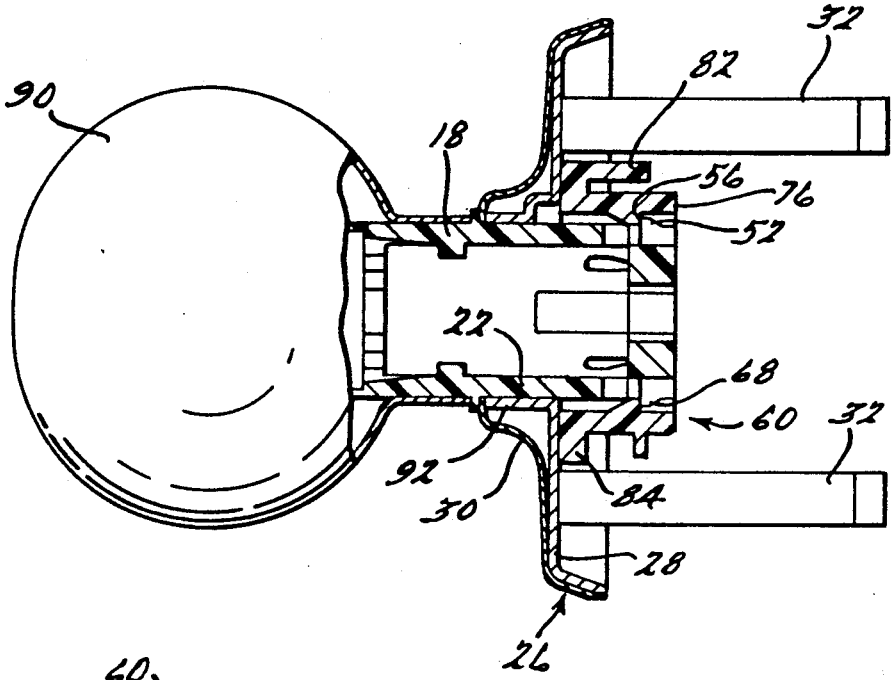
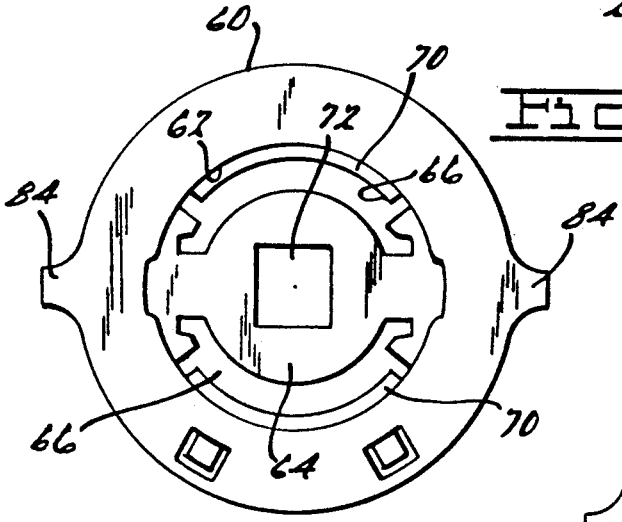
Fig. 4.
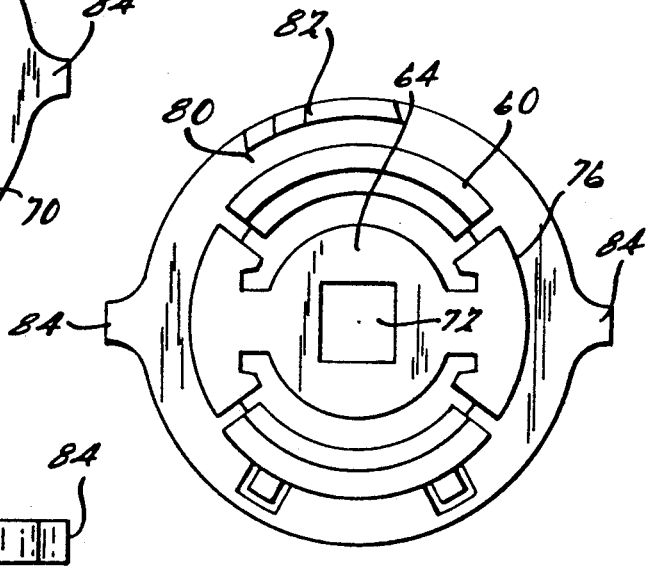
Fig. 5.
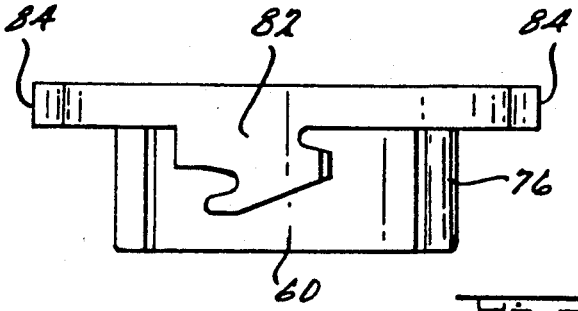
Fig. 6.

INTEGRAL DOOR KNOB ASSEMBLY WITH SPRING RETURN

TECHNICAL FIELD

The present invention relates to a door knob assembly and more particularly to a door knob assembly for mounting on a face of a door and having a spring return that rotates the knob back to a predetermined position upon release of the rotated knob. The assembly has an integral construction which performs the same function as existing types of door knobs which are made of several different components that require longer assembly time.

BACKGROUND OF THE INVENTION

In the past a single door knob assembly has been made of several different components which are held together by snap rings or by staking. Apart from the necessity of making the individual components, there are several stages of manufacture required to complete the assembly. The door knob assembly which comprises a door knob rotatable in a rose member has in the past generally been made of metal components and requires a special non-friction bushing to permit rotation between a door knob shank and the rose member. The bushing forms a bearing for easy rotation of the knob to disengage and re-engage a latch member to open and close the door.

By utilizing plastic materials for the integral door knob assembly of the present invention, the number of required components for the assembly is significantly reduced and the requirement of a separate non-friction bushing for rotation purposes is obviated by the present invention wherein the shank itself may be made of plastic material suitable as a bearing material. Furthermore, because the present invention utilizes a plastic resin material having flexibility and a snap lock arrangement for ease of assembling the door knob and rose member the need to assemble separate components together using snap rings or a staking operation is eliminated. The present invention results in fewer stages of manufacture and an overall reduction in total manufacture time.

SUMMARY OF THE INVENTION

It is an object of the present invention to provide a door knob assembly with a spring return which comprises a door knob member with a tubular shank formed of plastic material, the shank having a series of fingers that flex and form a snap lock attachment of the shank to the rose member with a molded plastic torsion spring assembly disposed about the end of the shank and having a snap lock engagement therewith. By utilization of special tools the snap lock can be disengaged and the plastic torsion spring assembly removed from the end of the shank, permitting the door knob member and the rose member to be separated and disassembled. This disassembly feature has not been available in existing types of door knob assemblies where staking has generally been used to assemble the components.

The present invention provides a door knob assembly having a knob member with a spring return, rotatably connected to a rose member for mounting on a face of the door, the knob member including a tubular shank formed of plastic material, the tubular shank having a tubular portion extending from the knob member with a plurality of fingers at the end of the tubular portion extending from the knob member with a plurality of fingers at the end of the tubular portion positioned about an axis of rotation for the knob member, the fingers formed by a plurality of slots in the tubular portion parallel to the axis, each of the fingers having snap lock engagement means at the end, the rose member having an internal bearing portion for supporting the tubular portion of the knob member permitting rotation of the shank therein, and two post members extending internally from the rose member for engagement with a door knob assembly mounted on the other side of the door, the post members spaced equidistant from the axis and in line therewith, a cylindrical spring assembly member formed of plastic material and having a concentric bore on one end for engagement with the tubular shank, curved openings in a face on the other end of the spring assembly member for receiving the fingers of the tubular shank in snap lock engagement, and attachment means in the face of the spring assembly member for axial attachment to a spindle, the knob member and spring assembly member having means to restrict rotation within the rose member, and spring means on the spring assembly member to return the knob member to a first predetermined position after at rotation and release.

BRIEF DESCRIPTION OF THE DRAWINGS

In drawings which illustrate embodiments of the present invention,

FIG. 1 is a sectional view showing a door knob assembly with a spring return as presently known in the prior art;

FIG. 2 is a sectional view showing a door knob assembly with a spring return according to one embodiment of the present invention;

FIG. 3 is an isometric exploded view showing the door knob components of the door knob assembly in FIG. 2;

FIG. 4 is a front elevation view of the spring assembly member shown in FIGS. 2 and 3;

FIG. 5 is a rear elevation view of the spring assembly member of FIG. 4;

FIG. 6 is a top plan view of the spring assembly member of FIG. 4; and

FIG. 7 is a sectional view showing another embodiment of a door knob assembly according to the present invention.

DESCRIPTION OF THE PREFERRED EMBODIMENT

Door knobs presently available today are generally made out of metal parts with a metal shank, steel knob liner and metal collar for the torsion spring assembly. FIG. 1 shows a typical door knob assembly known in the prior art with a door knob member 10 having a liner 12 with a knob shell 14 around the exterior turned and crimped to the outside lip of the knob liner 12. The knob shell 14 may be made from brass or other suitable material generally finished to have a shiny decorative surface. A knob face 16 is pressed into the knob liner 12 to complete the knob member 10. A shank 18, tubular in shape, fits in a hole provided in the knob member 10 and has the ends 20 staked so that the knob member 10 and shank 18 are rigidly attached together. The shank 18 has a parallel portion 22 which slides into a plastic bushing 24 forming part of a rose member 26. The bushing 24 is held to a rose liner 28 covered by a rose shell 30, the latter being formed of material similar to the knob shell 14 and fitting over the rose liner 28. Two posts 32 positioned equidistant from an axis 33 of the knob assembly and in line with the axis 33 extend in toward the center of the door and have tapped holes at their ends for engagement with an opposing door knob assembly on the other face of the door. One piece door knobs made of plastic are available on the market, but they generally do not have a plastic shank with snap lock fingers therein.

A torsion spring assembly 34 consisting of a metal inner tube member 36 supporting a torsion spring 38 and a metal outer tube member 40 surrounding the spring 38 and containing it in place. The outer tube member 40 has a flange that engages with the shank 18. The shank 18 is staked at its outer end so that the outer tube 40 of the spring assembly 34 is rigidly held to the shank member to form an assembly which consists of knob member 10, shank 18 and torsion spring assembly 34, all locked together. The spring ends extend radially from the spring 38 and engage with one or other of the posts 32. When the door knob member 10 is turned and released, it returns to an original position. The door knob member 10 may be rotated in either direction but as soon as it is released it returns to the original position. Clearance is provided between the shank 18 and bushing 24 sufficient for the knob member 10 to be rotated.

A door knob assembly according to one embodiment of the present invention is illustrated in FIGS. 2 and 3, wherein an integral door knob member 10 has a knob liner 12 formed integral with the shank 18. The material of construction for the knob liner 12 with integral shank 18 is resilient plastic and the unit is preferably injection molded. The knob liner 12 has strengthening ribs 44 joined to a central tube 46. The knob shell 14 covers the knob liner 12 in the embodiment shown in FIG. 2 and has a knob face 16 substantially the same as that known in the prior art.

In another embodiment, as illustrated in FIG. 3, the door knob assembly is made of a resilient plastic material which may be treated on the outside surface but is an integral unit without having to have a shell thereon.

The rose member 26 shown in FIG. 2, is a unitary construction and also may be made from resilient plastic material, or in another embodiment a metal. With at least one of the surfaces made of plastic material the necessity of a separate bushing to act as a bearing in the rose liner 28 is avoided. The parallel portion 22 of the shank 18 fits within an internal bearing portion 48 of the rose liner 28. As may be seen the shank member 18 has exterior round ribs 50 for ease of molding. These ribs 50, as shown in FIG. 2, are covered by the knob shell 14.

The integral shank 18 has fingers 52 at the end formed by slots 54 being cut in the tube end parallel to the axis 33. The fingers 52 have shoulders 56 facing the knob assembly 10 extending radially out from the shank 18 and a tapered portion 58 extending toward the end of the shank 18, thus forming a snap clip. The material of the shank 18 is resilient and thus the fingers 52 flex.

A unitary plastic molded cylindrical spring assembly member 60 has a concentric bore 62 at one end and a face 64 at the other end with curved openings 66. The bore 62 of the spring member 60 fits over the end of the shank 18 with the fingers 52 fitting into the openings 66 in the face 64 and rim portions 68 in the openings 66 each have a first tapered portion 70 to engage the tapered portion 58 on the fingers 52 thus deflecting the fingers 52. The fingers 52 snap lock into position with the shoulders 56 of the fingers 52 engaging the rims 68 within the openings 66 of the spring assembly member 60.

The face 64 of the spring assembly member 60 has a square aperture 72 concentric therewith for engagement with a square spindle 74. The spindle 74 attaches to the latch mechanism (not shown) and also the door knob assembly (not shown) on the other face of the door (not shown).

The spring assembly member 60 has an outside tubular portion 76 around which a helical torsion spring 38 is mounted. Two arms 78 of the spring 38 extend out far enough to engage the posts 32 of rose member 26. A flange 80 on the inside face of assembly member 60 contains the spring 38 and also has a spring catch 82 which engages one or other of arms 78. Rotating the knob member 10 torsions the spring 38 because the arms 78 are held against one of the posts 32. When the knob is released, then spring 38 causes knob member 10 to return to the original position.

Two protrusions 84 extend out from flange 80 of spring assembly 60 and engage the posts 32 to ensure that knob member 10 cannot be rotated too far. In the original position, the protrusions 84 are midway between the posts 32, thus approximately a quarter turn can be made in either direction.

The cylindrical assembly member 60 comprises only a single component with a torsion spring 38 thereon and this in turn engages with an integral shank 18 of a knob member 10. The rose member 26 is substantially an integral unit and in one embodiment the posts 32 are formed of plastic material and integral with the rose liner 28. Thus, with an integral knob member 10 having face and shank all molded as one, an integral rose member 26 having integral posts 32 and the spring assembly member 60, there are only three molded components as against the many components required for the design shown in the prior art.

In another embodiment a spherical knob 90 is shown in FIG. 4 attached to a shank 18 in a manner similar to that shown in FIG. 2 but without the molding ribs 50. The rose member 26 has a liner 28 similar to that shown in FIG. 1 covered by a rose shell 30. The liner 28 is joined to or may be integral with a sleeve 92 that has a sliding and rotating fit with the parallel portion 22 of the shank 18. The spring assembly member 60 fits onto the end of shank 18 in the manner described and shown herein.

The preferred plastic material is sold under the trademark DELRIN. For assembly purposes the spring 38 is mounted to the spring assembly member 60, the shank 18 is pushed through the internal bearing portion 48 of the rose member 26 and the spring assembly member 60 pushed over the end of the shank 18 so that the fingers 52 engage in the curved openings 66 in the face 64 of the spring assembly member 60.

If it is necessary to disassemble the unit, then two tools are required, one to spread apart the torsion spring 38 so the spring can be removed and a second tool to engage the fingers 52 at the end of the shank 18 and press them inward until the fingers disengage from the rims 70 in the openings 60, the shank 18 may then be pushed out of the spring assembly member 60. This permits separate worn or broken components to be replaced rather than discarding a complete assembly.

The knob member 10 with integral shank 18 may be used for three lock set functions, namely, passage, privacy and locking. In another embodiment the integral shank 18 includes a bayonet attachment for connection to a cylinder housing and plug assembly.

Various changes may be made to the embodiments shown herein without departing from the scope of the present invention which is limited only by the following claims.

We claim:

1. A door knob assembly having a knob member with a spring return, rotatably connected to a rose member for mounting on a face of the door, the knob member including a tubular shank formed of plastic material, the tubular shank having a tubular portion extending from the knob member with a plurality of fingers at the end of the tubular portion positioned about an axis of rotation for the knob member, the fingers formed by a plurality of slots in the tubular portion parallel to the axis, each of the fingers having snap lock engagement means at the end thereof;

the rose member having an internal bearing portion for supporting the tubular portion of the knob member permitting rotation of the shank therein, and two post members extending internally from the rose member for engagement with a door knob assembly mounted on the other side of the door, the post members spaced equidistant from the axis and in line therewith;

a cylindrical spring assembly member formed of plastic material and having a concentric bore on one end for engagement with the tubular shank, curved openings formed in a face on the other end of the spring assembly member for receiving the fingers of the tubular shank in snap lock engagement, and attachment means in the face of the spring assembly member for axial attachment to a spindle, the knob member and spring assembly member having means to restrict rotation within the rose member, and spring means on the spring assembly member to return the knob member to a first position after partial rotation and release.

2. The door knob assembly according to claim 1 wherein the snap lock engagement means comprises a shoulder on each of the plurality of fingers facing the knob member with a tapered portion extending toward each finger end, and wherein the shoulder on each of the fingers snap locks to rim portions of the spring assembly member within the curved openings.

3. The door knob assembly according to claim 1 wherein the means to restrict rotation between the spring assembly member and the rose member comprises at least one protrusion from a flange of the spring assembly member that contacts one post of the rose member when the knob member is rotated in one direction and the other post of the rose member when the knob member is rotated in the other direction.

4. The door knob assembly according to claim 1 wherein the spring means comprises a torsion spring mounted on the spring assembly member with at least one end to engage one of the two posts of the rose member.

5. The door knob assembly according to claim 1 wherein the attachment means in the face of the spring assembly member comprises a non-round hole in the face concentric with the tubular shank.

6. The door knob assembly according to claim 1 wherein the knob member comprises a liner formed of plastic and having strengthening ribs therein with a metal outside shell.

7. The door knob assembly according to claim 1 wherein the knob member comprises a single unitary plastic construction.

8. The door knob assembly according to claim 1 wherein the rose member is a single unitary construction formed of metal.

9. The door knob assembly according to claim 1 wherein the rose member is a single unitary construction formed of plastic material.

10. The door knob assembly according to claim 1 wherein the rose member has a rose liner formed of metal and a rose shell formed of metal covering the liner.

11. The door knob assembly according to claim 1 wherein the knob member and shank are integral therewith formed of plastic material.

* * * * *